US005857530A

United States Patent [19]

Gronseth

[11] Patent Number: 5,857,530

[45] Date of Patent: Jan. 12, 1999

[54] VERTICAL POSITIONING SYSTEM FOR DRILLING BOREHOLES

[75] Inventor: J. Mark Gronseth, Calgary, Canada

[73] Assignee: University Technologies International Inc., Calgary, Canada

[21] Appl. No.: 548,756

[22] Filed: Oct. 26, 1995

[51] Int. Cl.[6] ..... E21B 7/08; E21B 47/12

[52] U.S. Cl. ..... 175/45; 175/26

[58] Field of Search ..... 175/19, 26, 45, 175/62, 73, 74; 166/298

[56] References Cited

U.S. PATENT DOCUMENTS

| | | | |
|---|---|---|---|
| 2,720,381 | 10/1955 | Quick | 255/1.8 |
| 3,155,177 | 11/1964 | Fly | 175/67 |
| 4,016,942 | 4/1977 | Wallis et al. | 175/45 |
| 4,317,492 | 3/1982 | Summers et al. | 175/79 |
| 4,391,336 | 7/1983 | Coon et al. | 175/45 |
| 4,399,877 | 8/1983 | Jackson et al. | 175/45 |
| 4,527,639 | 7/1985 | Dickinson et al. | 175/61 |
| 4,592,432 | 6/1986 | Williams et al. | 175/26 |
| 4,597,067 | 6/1986 | Bockhorst et al. | 367/82 |
| 4,674,579 | 6/1987 | Geller et al. | 175/45 |
| 4,693,327 | 9/1987 | Dickinson et al. | 175/61 |
| 4,715,128 | 12/1987 | Cummings et al. | 33/544 |
| 4,763,734 | 8/1988 | Dickinson et al. | 175/61 |
| 4,787,463 | 11/1988 | Geller et al. | 175/45 |
| 4,821,815 | 4/1989 | Baker et al. | 175/26 |
| 4,896,733 | 1/1990 | Baker et al. | 175/26 |
| 4,974,672 | 12/1990 | Dickinson et al. | 166/55.1 |
| 5,133,418 | 7/1992 | Gibson et al. | 175/45 |
| 5,373,906 | 12/1994 | Braddick | 175/67 |
| 5,385,205 | 1/1995 | Hailey | 166/55.8 |
| 5,392,858 | 2/1995 | Peters et al. | 166/298 |
| 5,431,220 | 7/1995 | Lennon et al. | 166/55 |
| 5,445,220 | 8/1995 | Gurevich et al. | 166/55 |

OTHER PUBLICATIONS

New tools, techniques reduce high–angle drilling costs, Ensco Technology Co., Offshore, Nov. 1989, pp. 47–53.

The Lance[SM] Formation Penetrator System, Alan D. Peters, Penetrators, Inc. Feb. 24, 1987, 18 pages.

MTS Systems Corporation product brochure, Temposonics™ II Products, 1991, 2 pages.

MTS Systems Corporation product specification, Model 458.20B MicroConsole™, 1989, 4 pages.

MTS Systems Corporation product specification, Model 458.91 MicroProfiler™, 1990, 4 pages.

MTS Systems Corporation product specification, Model 458.15 Valve Controller, 1987, 4 pages.

MTS Systems Corporation product specification, Model 458.13 AC Controller, 1988, 4 pages.

MTS Systems Corporation product specification, Model 458.11 DC Controller, 1989, 4 pages.

(List continued on next page.)

*Primary Examiner*—William P. Neuder
*Attorney, Agent, or Firm*—Anthony R. Lambert

[57] ABSTRACT

A borehole drilling system has a well tubing actuator with a well tubing connector on a working end of the well tubing actuator, a transducer responsive to longitudinal movement of the working end of the well tubing actuator and a control system for the well tubing actuator to provide controlled longitudinal movement of the well tubing connector using a selected drilling program and feedback from the transducer. Plural lengths of well tubing are connected to the well tubing connector, with a jet drilling apparatus connected to the downhole end of the well tubing. An underreamer apparatus may be attached to the bottom hole end of the well tubing. Coiled tubing may be attached to the bottom hole end of the well tubing and directed through a whipstock. A method of drilling a borehole comprising moving well tubing longitudinally in a borehole with a well tubing actuator mounted on a frame, producing electrical output corresponding to longitudinal movement of a working end of the well tubing actuator; and controlling longitudinal movement of the working end of the well tubing actuator according to a selected drilling program and using the electrical output as feedback. The method may be used for drilling, section milling and underreaming.

12 Claims, 5 Drawing Sheets

OTHER PUBLICATIONS

Halliburton Services Limited Technical Data, Precise Pipe Control Unit, 1989, 2 pages.

Investigation of Abrasive–Laden–Fluid Method for Perforation and Fracture Initiation, Forrest C. Pittman, Don W. Harriman, Halliburton Company, Duncan Oklahoma, Reprinted from May, 1961, issue of Journal of Petrolem Technology, 1 page and pp. 489–495.

Halliburton Services Limited, Hydra–Jet, undated, 11 pages, precedes 1992.

Esso Resources Northern Operations Division, Project Execution Plan, Radial Borehole Field, Trial at Judy Creek Jan., 1992, Report #ERCL.OP.92.01, R.E. Nieman.

U.S. Patent Office Gazette Notice of Issue of U.S. Patent No. 5,193,620, Braddick Mar. 1993.

U.S. Patent Office Gazette Notice of Issue of U.S. Patent No. 5,411,099, Braddick May 1995.

VERTICAL POSITIONING SYSTEM-ASSEMBLY SCHEMATIC

VERTICAL POSITIONING SYSTEM FOR DRILLING BOREHOLES

FIELD OF THE INVENTION

This invention relates to the art of drilling boreholes and effecting other downhole operations with jets of fluid.

BACKGROUND OF THE INVENTION

In the art of drilling boreholes in the earth, difficulties are encountered when using jet drilling techniques to advance a borehole, particularly when drilling radial boreholes from a vertical borehole. In jet drilling, a high pressure jet of fluid, often a slurry of water and abrasive material, is directed at a formation to be penetrated from a nozzle at the end of a drill string. The nozzle is moved slowly through the formation with the jet of abrasive slurry cutting away the rock ahead of the nozzle. Abrasive slurry is returned to the surface. Examples of jet drilling techniques used in the drilling of radial boreholes are described in U.S. Pat. No. 5,373,906 of Braddick and U.S. Pat. No. 4,763,734 of Dickinson et al. In these patents jet drilling systems are described in which a jet nozzle at the end of a length of coiled tubing is advanced around a short radius whipstock to move from a vertical to horizontal orientation and thus be able to drill multiple radial boreholes from a central borehole.

One difficulty encountered in jet drilling through a short radius whipstock is that the coiled tubing tends to jam in the whipstock if it is advanced too slowly, and to overtake its ability to cut into the formation if advanced too quickly. In situations where the range of acceptable rate of advance is small, for example when drilling in geological targets with high unconfined compressive strength, prior devices for advancing the coiled tubing, for example as described in U.S. Pat. No. 4,763,734 of Dickinson et al, have been tested and found unsatisfactory.

In addition, previously known hydraulic actuators used for the control of advance of jet drilling apparatus, such as the Precise Pipe Control Unit of Halliburton Services Limited of Calgary, Canada, are not believed to have the degree of control required to advance a jet nozzle at a satisfactorily controlled rate and therefore have not been used for this purpose.

A further lacking of previously known drilling jet drilling systems is their inability to remove casing and subsequently underream the formation to make an enlarged borehole suitable for placement of a whipstock. The inventor has found that this difficulty arises from the lack of ability to suitably control the rate of advance and rate of rotation of the jet nozzle. For example, so far as known to the inventor, the Precise Pipe Control Unit of Halliburton has only been used for cutting slots in casing and not for section milling and underreaming. The consequence of failure to precisely control section milling or underreaming is that if any casing is left behind, or the formation is not underreamed fairly uniformly, the subsequent drilling operations cannot be carried out. For example, underreaming cannot be carried out if section milling is incomplete and a whipstock cannot be installed if the underreaming is incomplete. Tripping out of a borehole is expensive, so it is desirable to complete each task sequentially.

SUMMARY OF THE INVENTION

This invention addresses the problem of precisely controlled drilling with jet drilling apparatus, and also provides controlled advancement and retraction of downhole equipment in other downhole operations where controlled advancement and retraction of downhole equipment is required.

According to one aspect of the invention, there is provided a drilling system for controlled drilling of a borehole that includes a well tubing actuator having a working end, means to connect well tubing to the working end of the well tubing actuator, means to power the well tubing actuator, and a closed loop control system for the well tubing actuator for controllably advancing well tubing in a borehole.

According to a further aspect of the invention, the well tubing actuator is hydraulically powered.

According to a further aspect of the invention, the closed loop control system includes a transducer having electrical output indicative of a variable physical characteristic of the well tubing. The transducer forms means to produce an electrical signal representative of the variable physical characteristic of the well tubing.

In one aspect of the invention, the variable physical characteristic is the longitudinal displacement of the well tubing (which also corresponds to movement of a piston within the well tubing actuator), and the transducer is a displacement transducer.

In a further aspect of the invention, the variable physical characteristic of the well tubing is strain on the well tubing, and the transducer is a strain gauge.

Signals from the transducer may be used to control the actuator and produce a desired rate of movement, advancement or retraction, of the actuator and well tubing.

According to a further aspect of the invention, there is provided means to compare the electrical output of the transducer with an electrical signal representative of a desired rate of movement of the actuator and thus the well tubing, or strain on the well tubing, and produce an error signal for controlling the rate of advancement of the well tubing.

According to a further aspect of the invention, there is provided means to locate the well tubing actuator over a borehole.

According to a further aspect of the invention, there is provided means to rotate well tubing connected to the well tubing actuator.

According to a further aspect of the invention, the system includes plural lengths of well tubing connected to the well tubing connector, with a jet drilling apparatus connected to the downhole end of the well tubing.

According to a further aspect of the invention, the system includes a tee mounted between the well tubing actuator and the well tubing and a high pressure fluid conduit attached to the tee. A power swivel may form part of the tee.

According to a further aspect of the invention, the system includes an underreamer apparatus attached to the bottom hole end of the well tubing.

According to a further aspect of the invention, the system includes coil tubing attached to the bottom hole end of the well tubing.

According to a further aspect of the invention, the system includes a whipstock mounted on the bottom hole end of the well tubing for directing the coiled tubing in a selected direction.

According to a further aspect of the invention, there is provided a method of drilling a borehole comprising moving well tubing longitudinally in a borehole with a well tubing actuator mounted on a frame, producing electrical output corresponding to a variable physical characteristic of the well tubing actuator; and controlling longitudinal movement of the working end of the well tubing actuator according to a selected drilling program and using the electrical output as feedback.

According to a further aspect of the invention, the method includes attaching coiled tubing to the well tubing, locating the coiled tubing in a part of the borehole to be drilled and injecting high pressure fluid into the coiled tubing and moving the coiled tubing according to the selected drilling program.

According to a further aspect of the invention, the method includes attaching a fluid operated underreamer to the well tubing; locating the fluid operated underreamer in a part of the borehole to be underreamed and injecting high pressure fluid into the fluid operated underreamer according to the selected drilling program.

According to a further aspect of the invention, the method includes locating a jet section milling apparatus adjacent a section of casing to be milled, the jet section milling apparatus having a section milling jet nozzle directed towards the section of casing, controllably moving the section milling jet nozzle longitudinally and rotationally in the borehole to remove a desired section of the casing.

The section milling jet nozzle is preferably suspended on a tubing string and the method includes moving the section milling jet nozzle by longitudinal and rotational movement of the tubing string.

The section milling jet nozzle is preferably moved by a controlled hydraulic actuator mounted outside of the borehole, and the hydraulic actuator is controlled by a feedback control mechanism.

The underreaming jet nozzle is preferably suspended on a tubing string and the method preferably includes moving the underreaming jet nozzle by longitudinal and rotational movement of the tubing string, and the underreaming jet nozzle is moved by a controlled hydraulic actuator mounted outside of the borehole, with the hydraulic actuator controlled by a feedback control mechanism.

According to a further aspect of the invention, there is provided a method of underreaming a borehole, the method comprising the steps of locating a jet underreaming apparatus adjacent a section of borehole to be underreamed, the jet underreaming apparatus having an underreaming jet nozzle directed towards the section of borehole; and controllably moving the underreaming jet nozzle longitudinally and rotationally in the borehole to remove a desired amount of the borehole.

According to a further aspect of the invention, there is provided a method of section milling material in a borehole having casing, the method comprising the steps of locating a jet section milling apparatus adjacent a section of casing to be milled, the jet section milling apparatus having a section milling jet nozzle directed towards the section of casing, and controllably moving the section milling jet nozzle longitudinally and rotationally in the borehole to remove a desired section of the casing.

These and other aspects of the invention are described in the detailed description and the claims that follow.

BRIEF DESCRIPTION OF THE DRAWINGS

There will now be described preferred embodiments of the invention, with reference to the drawings, by way of illustration, in which like numerals denote like elements and in which.

DETAILED DESCRIPTION OF PREFERRED EMBODIMENTS

Figure 1:
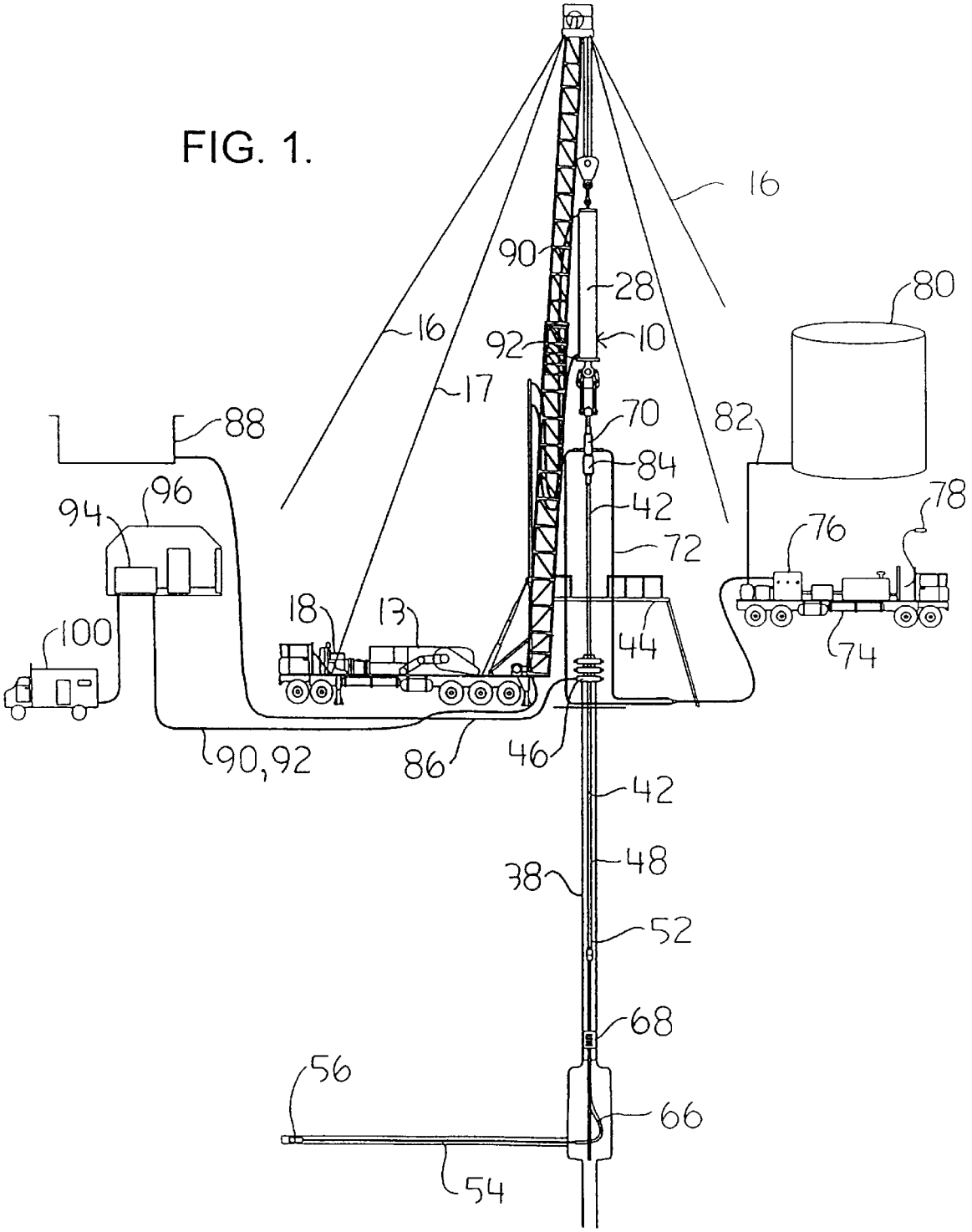
FIG. 1 is a schematic showing an embodiment of apparatus used in the invention located at a wellhead, with a well tubing actuator shown in a raised position.
Figure 2:
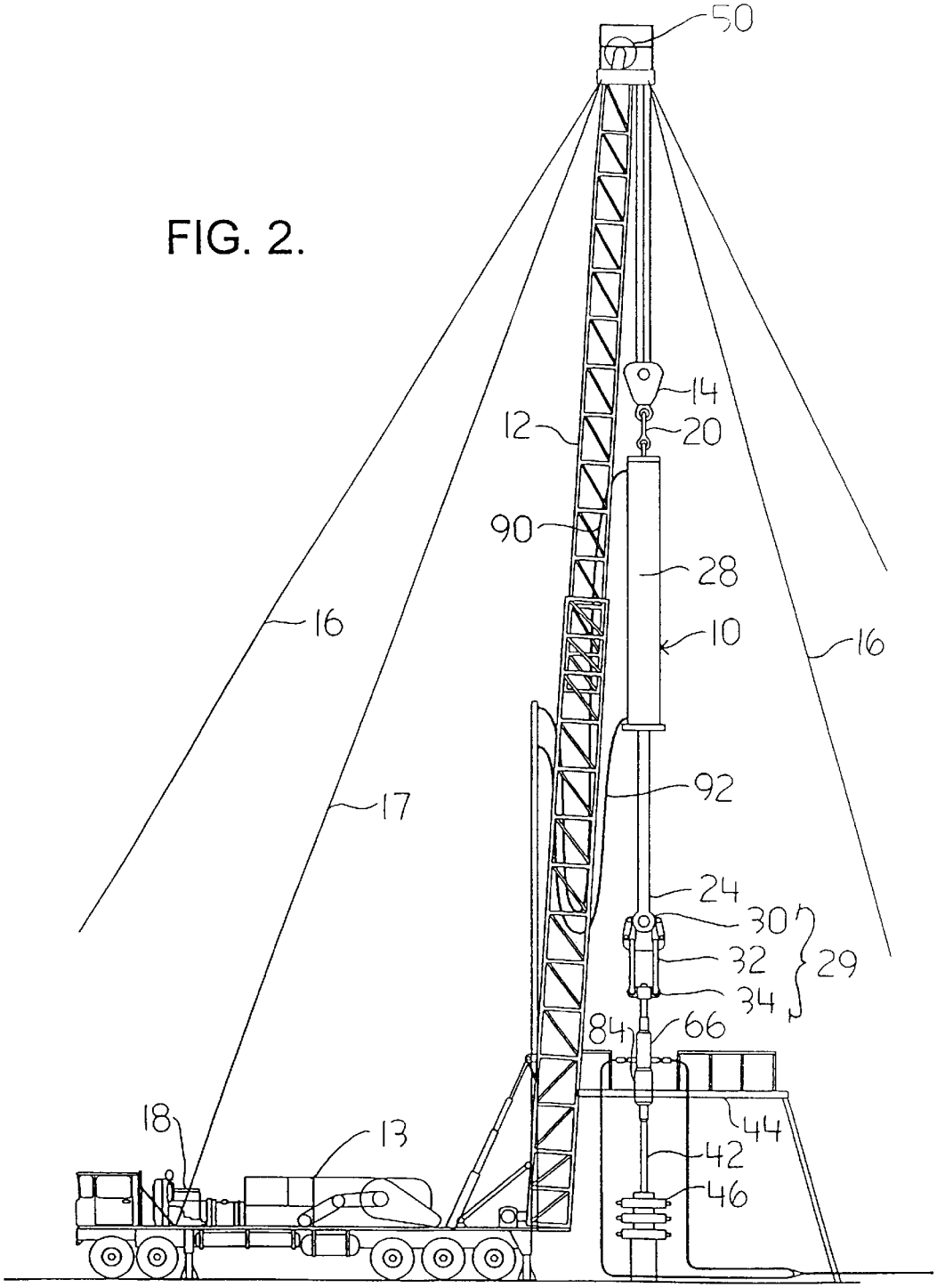
FIG. 2 is a close up of the rig shown in FIG. 1 with the well tubing actuator shown in a lower position.
Figure 5:
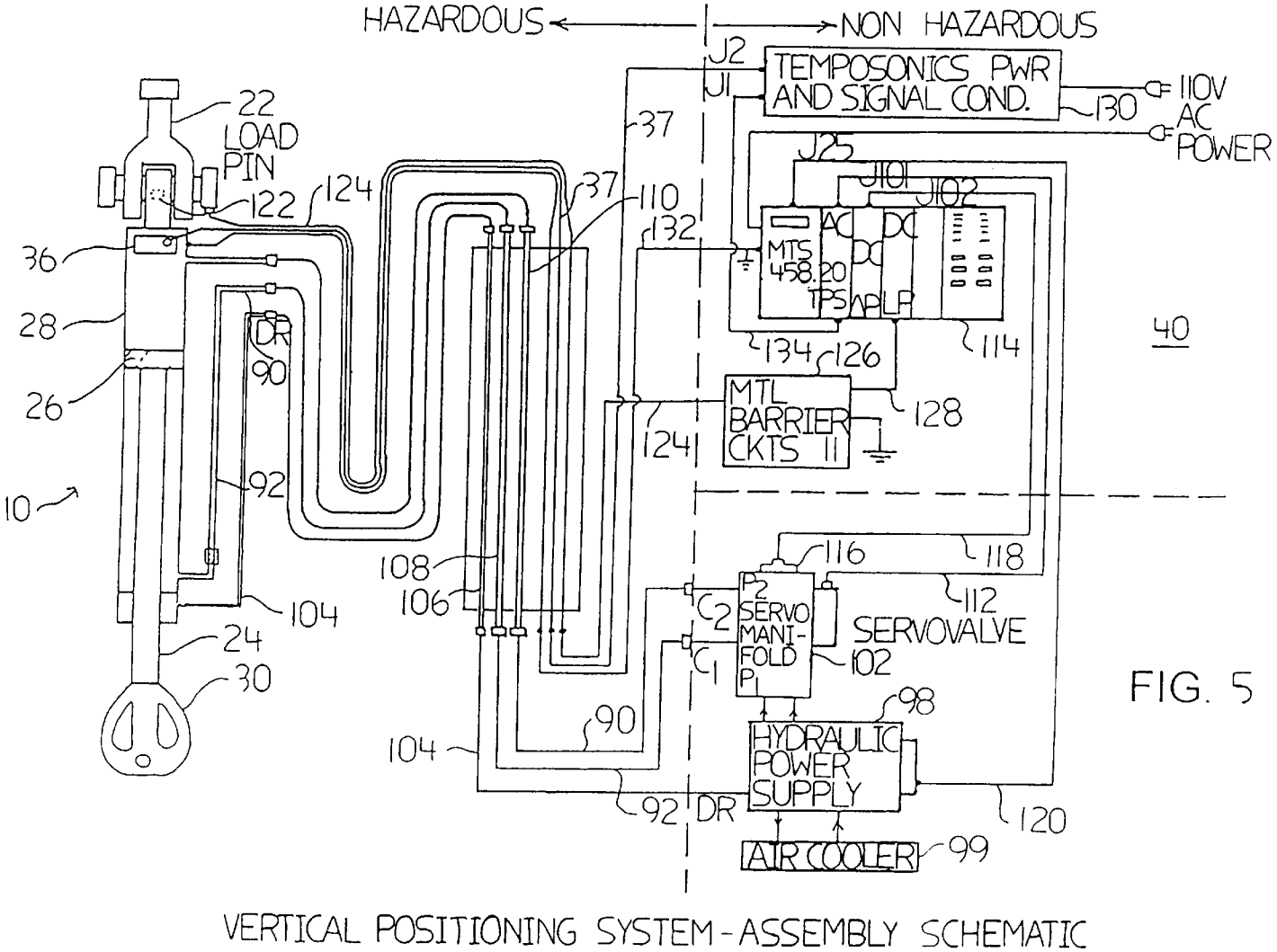
FIG. 5 is a control schematic with control system for the embodiment of the invention shown in FIG. 1.

Referring to FIGS. 1, 2 and 5, there is shown a borehole drilling system according to the invention. A hydraulically operated well tubing actuator 10 is mounted on a frame 12 for location over a borehole. In this instance, the frame 12 is a conventional mast supported by a conventional service rig 13 and the well tubing actuator 10 is hung from a conventional travelling block 14 suspended on cables 16, 17. One cable 17 extends to conventional drawworks 18. The well tubing actuator 10 is connected to the block 14 through conventional bails and elevators 20 and quill 22 (see in particular FIG. 5). The quill 22 is conventional, such as may be obtained from B. W. Rig Repair of Edmonton, Alberta, Canada. The well tubing actuator 10 is preferably an actuator assembly Model No. 243.65T available from MTS Systems Corp., Minneapolis, capable of 200,000 lbs tension and a 240 in. (6096 mm) stroke. The well tubing actuator 10 has a working end 24 that extends from a piston 26 mounted inside cylinder 28 of well tubing actuator 10, and thus activation of the piston 26 by hydraulic action causes the working end 24 to move longitudinally in relation to the frame 12. The piston 26 divides the cylinder 28 into two chambers, upper and lower, for the introduction of hydraulic fluid through lines 90 and 92. The working end 24 terminates away from the cylinder 28 in a well tubing connector 29 that is formed of conventional hook 30 (for example a McKissick hook with 100 ton capacity), bails 32 and elevators 34 all attached to the working end 24 of the well tubing actuator 10. The well tubing connector 29 forms a means to connect well tubing to the well tubing actuator.

As seen best in FIG. 5, a feedback system for the well tubing actuator 10 includes a transducer 36 located at one end of the cylinder 28. The transducer 36 is responsive to longitudinal displacement of the working end 24 of the well tubing actuator 10 by sensing the distance from its location in the cylinder 28 to the piston 26 and has electrical output corresponding to longitudinal displacement of the working end 24 of the well tubing actuator 10. The electrical output of the transducer thus forms position signals that indicate, equivalently: (a) the location of the piston 26 in the cylinder 28, (b) the location of the well tubing connector 29 and (c) the location of the well tubing 42 itself. The transducer 36 may be a Temposonics™ linear displacement transducer available from MTS Systems Corporation of Research Triangle, North Carolina, although other kinds of transducer may be used such as magnetostrictive, mechanical, capacitance, ultrasonic, pressure and radar. Conceivably, the transducer could be located elsewhere on the drill string, but it is convenient to have it on the cylinder 28.

The electrical output of the transducer 36 is provided to a control system 40 for the well tubing actuator 10. The control system 40 is responsive to electrical output from the transducer 36 on cable 37 to control longitudinal movement of the working end 24 of the well tubing actuator 10 according to a selected drilling program.

The well tubing connector 29 is used to suspend lengths of well tubing 42 from the well tubing actuator 10. The well tubing 42 passes through a conventional rig floor 44 and down through blow out preventors 46 and associated well head equipment into borehole 48. Borehole 48 is cased in casing 38. The drawworks 18, cables 16, 17, pulley 50 and travelling block 14 may be used in conventional fashion to raise and lower the well tubing actuator 10 on the mast.

Figure 3:
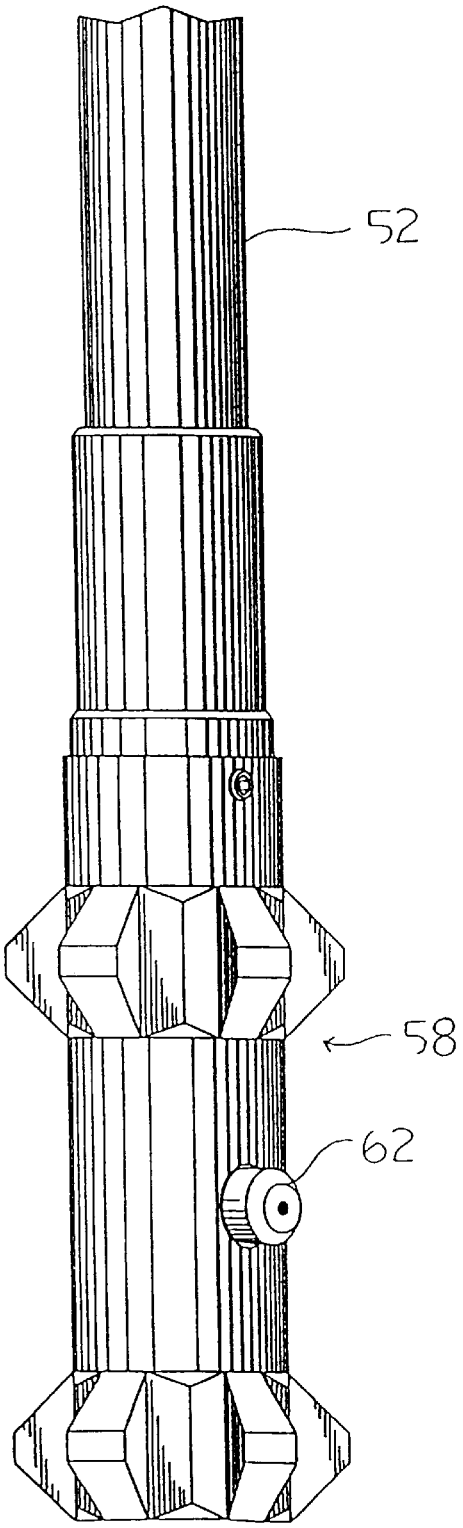
FIG. 3 is a side view of a section milling apparatus that could be used in the operation of the invention.
Figure 4:
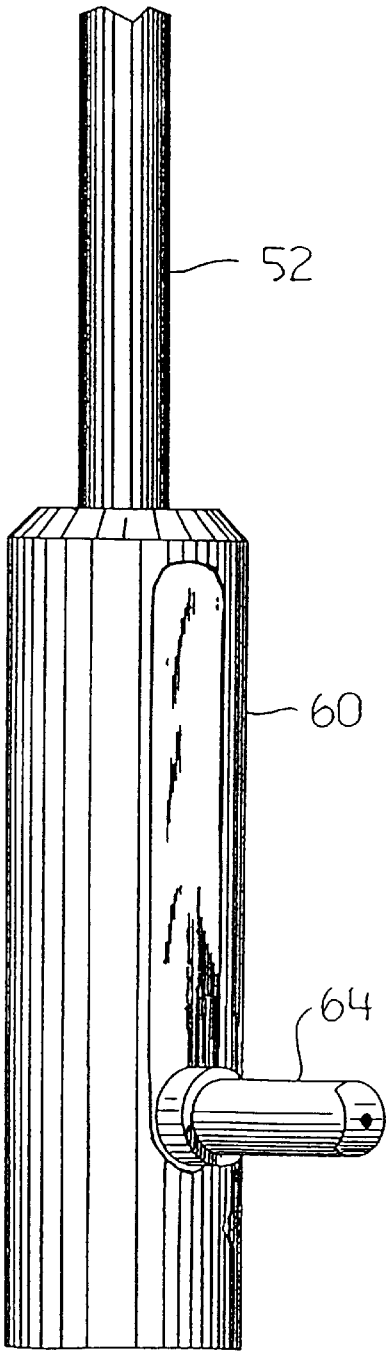
FIG. 4 is a schematic illustrating an underreaming apparatus with extendable nozzle for use in the practice of the invention.

The lengths of well tubing 42 have a downhole end 52 to which may be connected conventional coiled tubing 54 forming a jetting lance and a jet drilling apparatus 56. Alternatively, for section milling, a section milling apparatus 58 (FIG. 3) of conventional construction or an extendable underreaming apparatus 60 of conventional construction may be connected on the downhole end 52 of the well tubing 42. Examples of section milling apparatus and underreaming apparatus that could be used in the practice of the invention include those available from TIW of Houston, Tex., and the apparatus described in any of U.S. Pat. Nos. 5,385,205, or U.S. Pat. No. 5,445,220 the content of each of which is hereby incorporated herein by reference. The section milling apparatus 58 and underreaming apparatus 60 include jet nozzles 62 and 64 respectively directed radially outwards from the longitudinal axes of the tools 58 and 60. Other downhole equipment may be connected to the downhole end of the well tubing that requires, or may benefit from, controlled longitudinal movement, or controlled longitudinal and rotational movement.

The coiled tubing 54 should be selected for the intended drilling program in conventional manner. For example, 31.75 mm O.D., 3.96 mm wall, 70 KSI coiled tubing has been found satisfactory for use in drilling radial boreholes and for advancement through a short radius whipstock. The jet drilling apparatus 56 should also be selected for the intended use. For example, the jet drilling apparatus 56 may include multiple orifices or self rotating tool configurations to ensure a sufficiently wide borehole to advance the coiled tubing.

For drilling radial boreholes, a whipstock 66 is anchored in the borehole 48 with an anchor 68. Various designs of whipstock may be used, but the whipstock described in U.S. Pat. No. 5,373,906 is preferred. The whipstock 66 provides a curved path for the coiled tubing to follow and thus direct the coiled tubing in a desired radial drilling direction. The coiled tubing need not be directed in a perfectly horizontal direction, but may be at an angle to the horizontal.

A tee 70 is mounted in the drill string between the well tubing actuator 10 and the well tubing 42. A high pressure conduit 72, for example a 20,300 psi W.P. fire sheathed polyflex hose connected with a 3 inch 1502 frac iron pipe, connects to the tee 70 and runs out to a conventional high pressure pumper 74. Hydraulic pipes used in the high pressure portion of the drilling system described here should have a working pressure of at least 103.4 MPa, such as are used in high pressure hydraulic fracturing and acidizing operations. A flexible hose 72 is required to transmit fluid from the rig floor to the tee since the tee 70 moves with the movement of the well tubing actuator 10. The fluid used may be conventional abrasive slurry or other conventional fluid used in jet drilling. Pumper 74 includes a pump 76, for example a 1600 OPI triplex pump, a remote control unit 78 and is fed by a fresh water storage tank 80 via rubber suction hose 82. The tee 70 includes a conventional power swivel 84 that may be used to rotate the well tubing 42 during jet drilling, and particularly during section milling and underreaming. When the underreamer apparatus 60 or the section milling apparatus 58 or other downhole equipment are attached to the downhole end 52 of the well tubing 42 during underreaming or section milling operations, operation of the power swivel 84 causes the underreaming apparatus or the section milling apparatus to rotate at a controlled rate. For example, the well tubing may be caused to rotate at a speed of 2–4 rpm. Other means to rotate the well tubing 42 may be used, for example power tongs or a rotary table.

As drilling or other downhole jetting operations continue, fluid is returned up the annulus between the casing 38 and the well tubing 42 through the wellhead equipment 46 along return line 86 to conventional return tank 88.

Hydraulic fluid is provided to opposed ends of the well tubing actuator 28 via lines 90 and 92 connected to a hydraulic pumper 94 housed in hydraulic pumper building 96. The control system 40 for the well tubing actuator 10 is housed in a vehicle 100. The hydraulics and control system are best seen in FIG. 5.

Pumper 94 includes a 460 volt hydraulic power supply 98 with cooler 99 and a servo-valve 102, for example servovalve Model 760-1073A available from Moog Controls of New York. The power supply 98 includes a 3 phase, 50 HP, 60 Hz, hydraulic power supply available from MTS Systems Corp. Fluid is pumped by the pumper 94 with for example a variable displacement piston pump forming part of the hydraulic power supply 98. The cooler 99 may be a hydraulic oil air cooler 460 V, 3 phase, 60 Hz, available from MTS Systems Corp. A drain line 104 connects the lower end of the well tubing actuator 10 with the hydraulic power supply 98 through hydraulic standpipe 106. Servovalve 102 for example a STD RSP, 15 GPM model 252.55B-01 available from MTS Systems Corp. directs fluid from the hydraulic power supply 98 to the well tubing actuator 10 through lines 90 and 92 and standpipes 108 and 110. Lines 90, 92 and 104, as well as the standpipes 108 and 110 are all conventional and available from MTS Systems Corp. For example, the lines 90, 92 and 94 may be hydraulic hoses. A flow fuse 93, for example as is available from MTS Systems Corp., may be provided on the flow line 90.

The servovalve 102 is controlled by signals received on line 112 from controller 114 in the control system 40. A differential pressure transducer 116 measures the differential forces across the piston 26, corresponding to $P_1A_1-P_2A_2$, where $P_2$ is the pressure in line 90, $P_1$ is the pressure in line 92, $A_1$ is the area of the piston 26 facing downwards (towards end 24) and $A_2$ is the area of the piston 26 facing upwards, and provides an electrical signal corresponding to this differential force on line 118 to controller 114. Differential pressure transducer 116 may be model no. 660.23A available from MTS Systems Corp. Controller 114 may be an MTS 458.20 MicroConsole™ with AC controller, and two DC controllers, available from MTS Systems Corp. The controller 114 may be programmed through an MTS 458.91 Microprofiler™, which comes as a plug in module for the MTS 458.20 Microconsole™. A further line 120 conveys control signals from the controller 114 to the hydraulic power supply 98. Lines 112, 118 and 120 are conventional instrumentation cables available from MTS Systems Corp.

A load pin strain gauge 122 measures load on the load pin of the quill 22 and sends a signal representative of the load on conventional cable 124 to safety barrier circuits 126, also available from MTS Systems Corp. The barrier circuits 126 provide a signal on line 128 to controller 114. A power and signal conditioner 130 is connected to receive signals from transducer 36 on line 37, and to controller 114 on conventional cable 134 available from MTS Systems Corp. The power and signal conditioner 130 may be a Temposonics Power and Barrier Box available from MTS Systems Corp. A load pin emulator (not shown but it may simply be a resistive bridge) may be used to calibrate the load pin strain gauge 122.

Figure 6:
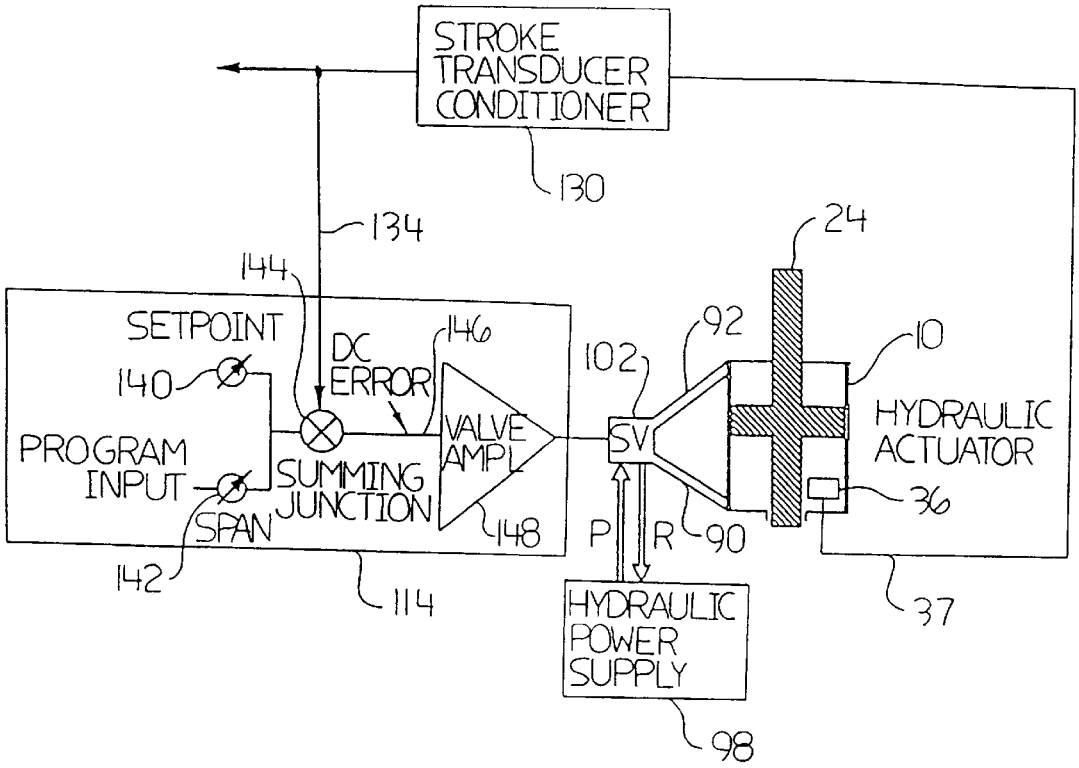
FIG. 6 shows a feedback circuit for use in the control system shown in FIG. 5.

The overall manner of operation of the vertical positioning system is as follows. The well tubing actuator 10 moves well tubing 42 longitudinally in the borehole 48 and thus controllably advance or retract the well tubing in the borehole. The well tubing 42 has downhole drilling or other operational tools such as an underreamer apparatus, section milling apparatus or jet drilling apparatus at its downhole end 52. Transducer 36 provides electrical output corresponding to longitudinal movement of the working end 24 of the well tubing actuator 10. Control system 40 controls the longitudinal movement of the working end 52 of the well tubing actuator 42 according to a selected drilling program and using the electrical output as feedback. The feedback system is shown in FIG. 6. A typical drilling program is to move the actuator at a set rate, for example, 6–10 mm/minute. This rate will vary depending on the drilling requirements and downhole conditions. Program input is provided at setpoint 140 (longitudinal movement rate) and may include span 142 (reference signals indicating start and stop points), although the starting and stopping can be controlled manually, for example by stopping when a desired amount of longitudinal movement has been obtained. In a preferred implementation, the program control parameters are input through an MTS 458.91 Microprofiler™, forming part of the controller 114. The control system of MTS Systems Corp. provides an indication of total displacement of the actuator so that it is easy for an operator to determine when to stop. The hydraulic power supply 98 drives fluid through the servovalve 102 and lines 90 and 92 under control of controller 114 to actuate the well tubing actuator 10. The longitudinal position of the working end 24 is sensed by the transducer 36 and a signal representative of the position is passed by the signal conditioner 130 on line 134 to summing junction 144 in controller 114. A DC error signal is provided on line 146, amplified by amplifier 148, and provided to servovalve 102 to change the fluid flow in lines 90 and 92 according to the deviation from the selected drilling program indicated by the DC error signal. The system therefore provides precise vertical positioning of the well tubing in the borehole, and consequently also precise horizontal positioning of a jet drilling apparatus in the case of drilling of a radial borehole using a whipstock.

Load on the well tubing may also be used to control the actuator. The load on the well tubing is detected by the load pin strain gauge 122. As for example, if a jet drilling apparatus on the end of the well tubing advances too quickly and contacts rock ahead of the nozzle, the load on the well tubing will be reduced. Detection of load reduction may then by used to pull back on the well tubing and/or slow the rate of advance of the well tubing. The control circuits in the MTS controller 114 for the actuator may also have pre-set load limits such that the actuator may be shut down and an alarm sounded if the load exceeds those limits. The control circuits may be set to allow a maximum strain on the well tubing (highest acceptable load) to avoid overtensioning the well tubing and a minimum strain (lowest acceptable load). Other transducers may also be used to control the movement of the well tubing.

The operation of the positioning system has particular applicability during jet drilling, hence with coiled tubing 54 attached to the well tubing 42. The coiled tubing 54 is located in a part of the borehole to be drilled, underreamed or section milled, and high pressure fluid is injected into the coiled tubing 54 by pump 76. The well tubing and hence the coiled tubing 54 is then moved with the well tubing actuator 10 according to the selected drilling program.

For section milling in a borehole having casing, a jet milling apparatus 58 is located adjacent a section of casing to be milled, with a milling jet nozzle 62 directed towards the section of casing to be milled. The jet milling apparatus and the jet nozzle 62 are then moved longitudinally and rotationally in the borehole to cut away the casing to the extent required. Longitudinal movement is controlled by the well tubing actuator 10 and control system 40 with feedback. Rotational movement may be controlled manually or automatically using the power swivel 84. By precise control allowed by the present system, it is possible to remove all of the casing over a given zone.

For underreaming, casing is removed by section milling, or where there is no casing, underreaming is commenced just below where the casing terminates. In either case, a fluid operated underreaming apparatus 60 is attached to the well tubing 42, the fluid operated underreaming apparatus is located in a part of the borehole to be underreamed and high pressure fluid is injected into the fluid operated underreaming apparatus according to the selected drilling program. The underreaming apparatus 60 is moved longitudinally in the borehole under control of the well tubing actuator 10 and control system 40 with feedback, and rotationally under control of the power swivel 84.

A person skilled in the art could make immaterial modifications to the invention described and claimed in this patent without departing from the essence of the invention.

The embodiments of the invention in which an exclusive property or privilege is claimed are defined as follows:

1. A borehole drilling system comprising:

a well tubing actuator mounted on a frame, the well tubing actuator having a working end movable longitudinally in relation to the frame by the well tubing actuator;

a well tubing connector attached to the working end of the well tubing actuator;

plural lengths of well tubing connected to the well tubing connector, the plural lengths of well tubing having a downhole end;

a jet drilling apparatus connected to the downhole end of the well tubing;

a tee mounted between the well tubing actuator and the well tubing;

a high pressure fluid conduit attached to the tee for supplying fluid to the jet drilling apparatus;

a transducer having electrical output corresponding to a variable physical characteristic of the well tubing; and a control system for the well tubing actuator, the control system being responsive to electrical output from the transducer to control longitudinal movement of the well tubing according to a selected drilling program.

2. The borehole drilling system of claim 1 in which the transducer is a displacement transducer oriented to be responsive to longitudinal displacement of the well tubing and the variable physical characteristic is the longitudinal displacement of the well tubing.

3. The borehole drilling system of claim 1 in which the transducer is a strain gauge oriented to be responsive to strain on the well tubing and the variable physical characteristic is the strain on the well tubing.

4. The borehole drilling system of claim 1 further comprising a power swivel connected to the well tubing, the power swivel being operatively connected to rotate the well tubing.

5. The borehole drilling system of claim 4 in which the plural lengths of well tubing have a bottom hole end and further comprising:

an underreamer apparatus attached to the bottom hole end of the well tubing.

6. The borehole drilling system of claim 4 in which the plural lengths of well tubing have a bottom hole end and further comprising:

a section milling apparatus attached to the bottom hole end of the well tubing.

7. The borehole drilling system of claim 4 in which the plural lengths of well tubing have a bottom hole end, and further comprising coiled tubing attached to the bottom hole end of the well tubing.

8. The borehole drilling system of claim 7 further comprising, when in operational position over a wellbore, a whipstock mounted in the wellbore for directing the coiled tubing in a selected direction.

9. A drilling system comprising;

a cylinder;

a piston mounted for longitudinal movement in the cylinder, the piston thereby dividing the cylinder into first and second chambers;

a shaft extending from the piston to a well tubing connector;

plural lengths of well tubing connected to the well tubing connector, the plural lengths of well tubing having a downhole end;

a jet drilling apparatus connected to the downhole end of the well tubing;

a tee mounted between the well tubing actuator and the well tubing;

a high pressure fluid conduit attached to the tee for supplying fluid to the jet drilling apparatus;

a power swivel connected to the well tubing for rotating the well tubing in the well;

a transducer having output representative of the location of the piston in the cylinder;

means to introduce hydraulic fluid into the first and second chambers;

a closed loop control system for controlling introduction of hydraulic fluid into the first and second chambers in accordance with a desired drilling program to thereby control location of the piston within the cylinder using the output from the transducer.

10. The drilling system of claim 9 in which the closed loop control system comprises means to compare the output of the transducer with an electrical signal corresponding to a desired rate of movement of the well tubing in a borehole and produce an error signal for controlling the rate of movement of the well tubing.

11. The drilling system of claim 10 further comprising means to locate the well tubing actuator over a borehole with well tubing suspended below the well tubing actuator.

12. The drilling system of claim 9 further comprising means to measure strain on the well tubing, the closed loop control system being responsive to the strain on the well tubing.

* * * * *